United States Patent [19]

Castel

[11] Patent Number: 4,688,341

[45] Date of Patent: Aug. 25, 1987

[54] APPARATUS FOR PROVIDING TWO INDICATORS IN ASSOCIATION WITH GOODS IN A STORE DISPLAY

[75] Inventor: Lawrence Castel, Stamford, Conn.

[73] Assignee: Coats & Clark, Inc., Stamford, Conn.

[21] Appl. No.: 772,325

[22] Filed: Sep. 4, 1985

[51] Int. Cl.[4] ..... G09F 3/20

[52] U.S. Cl. ..... 40/5; 40/486; 40/10 R

[58] Field of Search ..... 40/5, 486, 487, 488, 40/10 R, 6, 5, 10

[56] References Cited

U.S. PATENT DOCUMENTS

| | | | |
|---|---|---|---|
| 2,069,957 | 2/1937 | Klein | 40/324 |
| 3,469,813 | 9/1969 | Rizzi | 40/324 |
| 4,044,485 | 8/1977 | Hopp | 40/324 |
| 4,531,311 | 7/1985 | Howard et al. | 40/10 R |

*Primary Examiner*—Gene Mancene
*Assistant Examiner*—Wenceslao J. Contreras
*Attorney, Agent, or Firm*—Burgess, Ryan and Wayne

[57] ABSTRACT

An assembly for providing a visually discernible indicator and a bar code in association with goods to be sold, includes a tray having opposing side walls and a front panel containing the bar code in association with the goods; first and second clips secured to the opposing side walls, respectively, and each having a flange having an aperture therein; and an indicator panel containing the visually discernible indicator and including opposite tabs pivotally mounted within the first and second apertures so as to pivotally mount the indicator panel between a first position in covering relation to the front panel, and thereby in covering relation to the bar codes, and a second position exposing the front panel and bar codes.

10 Claims, 5 Drawing Figures

APPARATUS FOR PROVIDING TWO INDICATORS IN ASSOCIATION WITH GOODS IN A STORE DISPLAY

BACKGROUND OF THE INVENTION

This invention relates generally to an assembly for providing two separate indicators, such as a bar code and a name, for goods to be sold, and in particular, for providing such separate indicators with respect to a store display.

Many stores utilize displays or the like for selling their goods. Such displays often include a plurality of trays, each tray holding a plurality of different items. For example, one tray may hold a plurality of spools of thread in different rows thereof. Generally, the front panel of the tray has different indicators thereon to denote the type and color of the thread.

In order to modernize stores, many store owners have begun to utilize bar codes in connection with the products. Thus, when a customer purchases a product, the cashier merely passes the bar code over a scanner which reads the bar code, determines the price, adds the price to those items already purchased and subtracts the item from inventory. However, in many situations, it is desirable to perform inventory control using such bar codes. Thus, in the case of spool threads, it is necessary to provide bar codes on the trays adjacent the threads.

The problem that results is that the use of bar codes on the same front panel as the indicators which denote the type and color of the threads, for example, detracts the customer from such indicators.

OBJECTS AND SUMMARY OF THE INVENTION

Accordingly, it is an object of the present invention to provide an assembly for providing two separate indicators for goods to be sold in which only one indicator is exposed at a time.

It is another object of the present invention to provide an assembly for providing two separate indicators for goods to be sold in which a panel containing one of the indicators is pivotally secured to the tray in either covering or exposing relation to another panel containing the other indicator.

In accordance with an aspect of the present invention, an assembly for providing two separate indicators corresponding to goods contained in a tray of the type having opposing side walls and a front panel containing one of the indicators in association with the goods, includes first and second pivotal mounting means secured to the opposing side walls, respectively; and indicator panel means containing the other of the indicators pivotally mounted to the first and second pivotal mounting means for pivotal movement between a first position in covering relation to the front panel and a second position exposing the front panel.

In accordance with another aspect of the present invention, an assembly for providing two separate indicators for goods to be sold, includes a tray having opposing side walls and a front panel containing one of the indicators in association with the goods; first and second pivotal mounting means secured to the opposing side walls, respectively; and indicator panel means containing the other of the indicators pivotally mounted to the first and second pivotal mounting means for pivotal movement between a first position in covering relation to the front panel and second position exposing the front panel.

The above, and other, objects, features and advantages of the present invention will become readily apparent from the following detailed description thereof which is to be read in connection with the accompanying drawings.

DETAILED DESCRIPTION OF A PREFERRED EMBODIMENT

Figure 1:
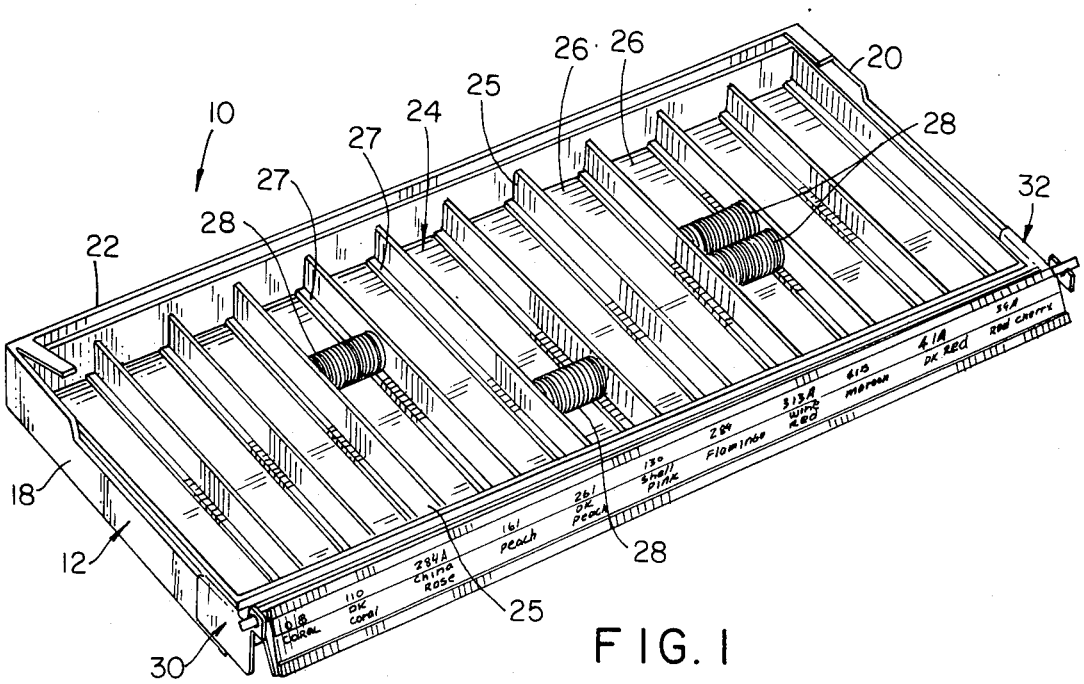
FIG. 1 is a perspective view of apparatus according to the present invention, with the indicator panel in covering relation to the front panel.
Figure 2:
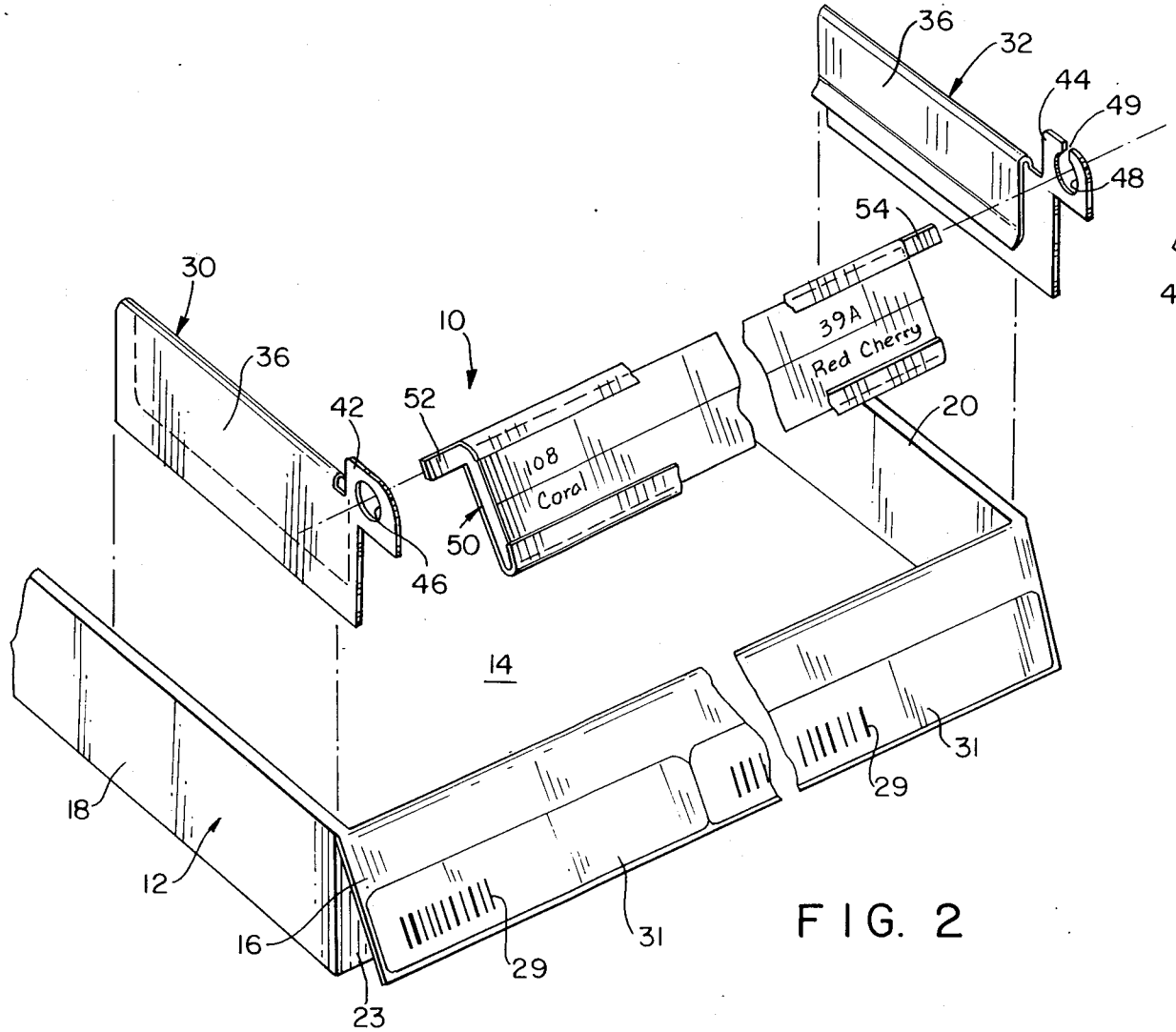
FIG. 2 is a blown-up and blown-apart view of a portion of the apparatus of FIG. 1, without the tray insert.

Referring to the drawings in detail, and initially to FIGS. 1 and 2 thereof, an assembly 10 according to the present invention for use with a tray 12 is shown. Tray 12 includes a bottom 14, front panel 16, opposing side walls 18 and 20. A rear wall 22 is provided. A front wall 23 behind front panel 16 is also provided.

Preferably, a tray insert 24 having a plurality of channels 26 formed therein is positioned within tray 12 with channels 26 having a longitudinal direction extending toward front panel 16. Channels 26 are separated by dividers 25. Channels 26 may also be formed with longitudinally extending ledges 27 at opposite sides thereof so that the consumer can easily remove the goods. In this regard, for example, spools of thread 28 are positioned within each channel 26. For example, green thread may be provided in one channel, red thread in another channel and white thread in still another.

As shown in FIGS. 1 and 2, front panel 16 is provided with a plurality of indicators, such as bar codes 29, in association with each channel 26. The bar codes 29 may be printed on stickers 31 which are applied to front panel 16.

Figure 3:
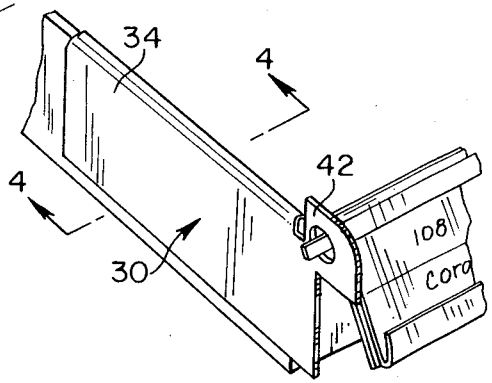
FIG. 3 is a blown-up view of one clip of the apparatus of FIG. 1, in assembled position.
Figure 4:
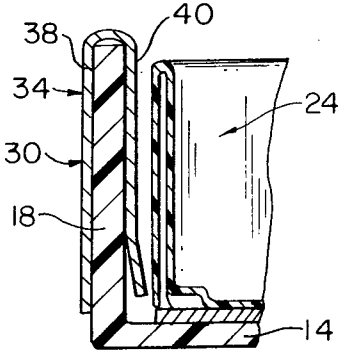
FIG. 4 is a cross-sectional view of the apparatus of FIG. 3, taken along line 4—4 thereof.

First and second pivotal mounting means 30 and 32 are secured to opposing side walls 18 and 20. Specifically, first and second pivotal mounting means 30 and 32 are in the form of U-shaped clips 34 and 36 as shown in FIGS. 2 and 4 having connected opposing legs 39 and 40 resiliently biased toward each other and which are separated by a distance less than the width of side walls 18 and 20 so as to clip thereon in a secure manner, as shown in FIGS. 3 and 4. Each clip 34 and 36 is provided with an upper flange 42 and 44, respectively, at the front end thereof. Flange 42 includes an enclosed aperture 46, while flange 44 includes an aperture 48 which is open at 49.

In accordance with the present invention, an indicator panel 50, which is of the same length as tray 12, is formed with tabs 52 and 54 at opposite ends thereof which fit within apertures 46 and 48, respectively, so as to pivotally mount indicator panel 50 therein. Indicator panel 50 includes various indicators 52 on the front face thereof, for example, designating the style code and color of the thread, as shown.

In this regard, indicator panel 50 is formed with opposing bent ears 52 extending in the lengthwise direction thereof for removably holding a cardboard strip 54 or the like having indicators 52 printed thereon.

As shown in FIG. 1, indicator panel 50 is pivoted to a first position in covering relation to the front panel of the tray. As shown in FIG. 2, indicator panel 50 is pivoted to a second position exposing front panel 16 of tray 12. Front panel 16 has various bar codes printed thereon, corresponding to the particular thread in the respective channel 26.

It will be appreciated that the specific indicators 52 provided with respect to indicator panel 50 may be changed by slidably removing cardboard strip 54 and inserting a new cardboard strip with different indicators thereon, within opposing ears 58 of indicator panel 50. Further, indicator panel 50 may be removed for cleaning, changing such a strip 54 or the like. In this regard, aperture 48 is open at 49 so that tab 54 can be removed therefrom so as to separate indicator panel 50 from tray 12.

Figure 5:
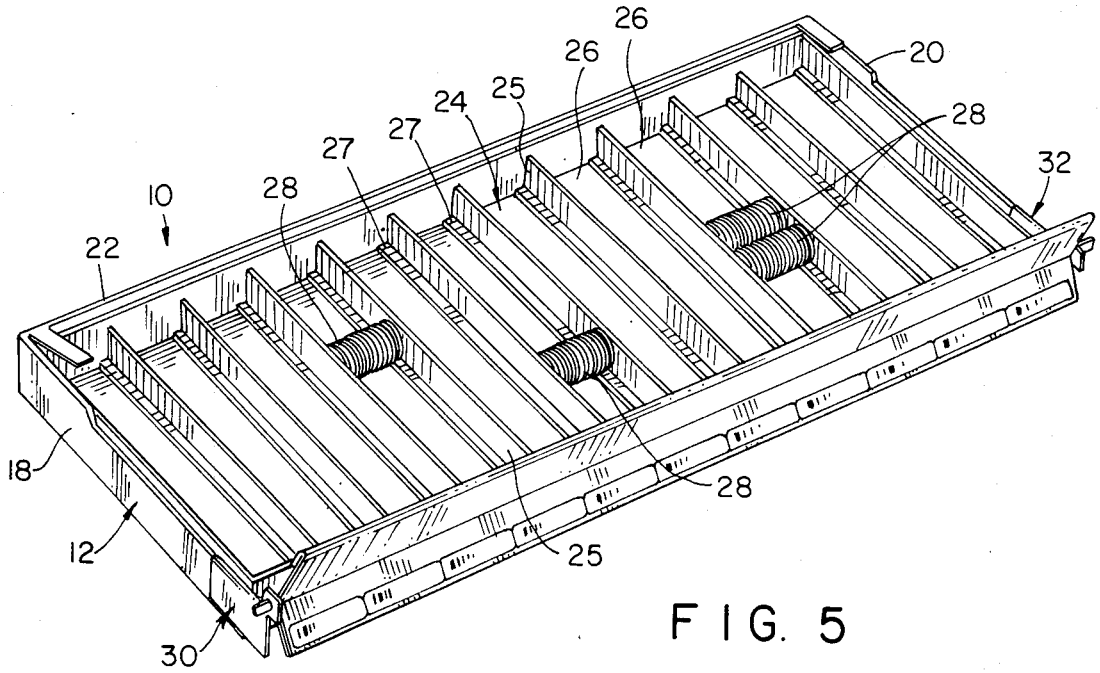
FIG. 5 is a perspective view of the apparatus of FIG. 1, with the indicator panel in exposing relation to the front panel.

In normal operation, indicator panel 50 is in the first position shown in FIG. 1 so that the consumer sees the color and style of thread then in the respective channel 26. When it is desired to perform an inventory check, a clerk pivots indicator panel 50 to its second position exposing front panel 16, as shown in FIG. 5. The clerk then positions the scanner at each respective bar code and presses buttons corresponding to the number of spools 28 then in the respective channel 26, which is used for inventory control.

Having described a specific preferred embodiment of the present invention with reference to the accompanying drawings, it is to be appreciated that the present invention is not limited to that precise embodiment, and that various changes and modifications may be effected therein by one of ordinary skill in the art without departing from the spirit or scope of the present invention as defined by the appended claims.

What is claimed is:

1. An assembly for providing two separate indicators corresponding to goods contained in a tray of the type having opposing side walls and a front panel containing one of the indicators in association with the goods, said assembly comprising:

first and second pivotal mounting means secured to said opposing side walls, respectively; and indicator panel means containing the other of said indicators pivotally mounted to said first and second pivotal mounting means for pivotal movement between a first position in covering relation to said front panel and a second position exposing said front panel.

2. An assembly according to claim 1, wherein said first and second pivotal mounting means includes first and second clip means, respectively, which clip onto said opposing side walls, each clip means including a flange having an aperture therein; and said indicator panel means including opposite tab means positioned within said apertures for pivotally mounting said indicator panel means between said first position and said second position.

3. An assembly according to claim 2, wherein one of said apertures is open to permit removal of said indicator panel means therefrom.

4. An assembly according to claim 1, wherein said indicator panel means includes opposing ears for removably containing an indicator strip containing the other of said indicators.

5. An assembly according to claim 4, wherein said one of said indicators is a bar code and the other of said indicators is at least one of a name and symbol visually discernible to a consumer.

6. An assembly for providing two separate indicators for goods to be sold, comprising:

a tray having opposing side walls and a front panel for containing one of said indicators in association with said goods;

first and second pivotal mounting means secured to said opposing side walls, respectively; and indicator panel means containing the other of said indicators pivotally mounted to said first and second pivotal mounting means for pivotal movement between a first position in covering relation to said front panel and a second position exposing said front panel.

7. An assembly according to claim 6, wherein said first and second pivotal mounting means includes first and second clip means, respectively, which clip onto said opposing side walls, each clip means including a flange having an aperture therein; and said indicator panel means including opposite tab means positioned within said apertures for pivotally mounting said indicator panel means between said first position and said second position.

8. An assembly according to claim 7, wherein one of said apertures is open to permit removal of said indicator panel means therefrom.

9. An assembly according to claim 6, wherein said indicator panel means includes opposing ears for removably containing an indicator strip containing the other of said indicators.

10. An assembly according to claim 5, wherein said one of said indicators is a bar code and the other of said indicators is at least one of a name and symbol visually discernible to a consumer.

* * * * *